US006120264A

United States Patent [19]

Wang

[11] Patent Number: 6,120,264

[45] Date of Patent: Sep. 19, 2000

[54] AIR PUMP OF SIMPLE STRUCTURE

[75] Inventor: Kenneth Wang, Taipei, Taiwan

[73] Assignee: Team Worldwide Corp., Taiwan

[21] Appl. No.: 09/330,045

[22] Filed: Jun. 11, 1999

[51] Int. Cl.[7] ..... F04B 43/02

[52] U.S. Cl. ..... 417/480; 417/53; 417/478; 92/89

[58] Field of Search ..... 417/244, 53, 440, 417/473, 480, 478, 472, 557; 92/89, 90, 91, 92

[56] References Cited

U.S. PATENT DOCUMENTS

| | | | |
|---|---|---|---|
| 282,090 | 7/1883 | Kennish | 417/480 |
| 2,369,736 | 2/1945 | Hurt | 417/480 |
| 2,686,006 | 8/1954 | Hasselquist | 230/160 |
| 2,991,763 | 7/1961 | Marette | 417/480 |
| 3,068,494 | 12/1962 | Pinkwater | 5/348 |
| 3,112,502 | 12/1963 | Forsberg | 5/348 |
| 3,118,596 | 1/1964 | Saile | 417/480 |
| 3,133,696 | 5/1964 | Mirardo | 92/92 |
| 3,216,413 | 11/1965 | Mota | 128/29 |
| 3,817,284 | 6/1974 | Daugherty | 137/614.13 |
| 4,521,166 | 6/1985 | Phillips | 417/478 |
| 4,694,515 | 9/1987 | Rogers, Jr. | 5/13 |
| 4,782,542 | 11/1988 | Sato | 5/453 |
| 4,862,533 | 9/1989 | Adams, III | 5/413 |
| 4,930,174 | 6/1990 | Hunter | 5/454 |
| 5,074,765 | 12/1991 | Pekar | 417/480 |
| 5,145,338 | 9/1992 | Murray | 417/480 |

FOREIGN PATENT DOCUMENTS

| | | | |
|---|---|---|---|
| 39 18 805 A1 | 6/1989 | Germany | F04B 43/00 |
| 40 34 593 A1 | 10/1990 | Germany | F04B 45/02 |
| 135148 | 8/1966 | New Zealand . | |
| 225036 | 9/1990 | New Zealand . | |
| 2 269 743 | 7/1993 | United Kingdom | A47C 27/08 |

*Primary Examiner*—Charles G. Freay
*Assistant Examiner*—Robert Z. Evora
*Attorney, Agent, or Firm*—Michael D. Bednarek; Crowell & Moring LLP

[57] ABSTRACT

An air pump includes a first sheet, a second sheet, an inflation valve and a check valve. The second sheet is directly connected to the first sheet so as to form a chamber. The inflation valve is provided on the chamber to lead air into the chamber when the chamber is extended. The check valve is also provided on the chamber to discharge the air in the chamber when the chamber is compressed. The air pump can be built in an inflatable product.

9 Claims, 21 Drawing Sheets

AIR PUMP OF SIMPLE STRUCTURE

BACKGROUND OF THE INVENTION

1. Field of the Invention

The present invention relates in general to a simplified, low-cost air pump.

2. Description of the Related Art

An inflatable product provided with an air pump has been disclosed in many patent documents, such as U.S. Pat. No. 5,827,052, which is a previous invention of this inventor's. FIGS. 9A and 9B show an embodiment of U.S. Pat. No. 5,827,052, in which an inflatable product (5) has a built-in air pump (59). The pump body of the air pump (59) is received in the inflatable product (5). Two stiff rings are fixed on the upper end and lower end of the pump body. In operation, the user extends the air pump (59) to suck outside air into the pump body through a check valve by pulling two bands in opposite directions. Then, the user compresses the air pump (59) to push air (600) in the pump body into the inflatable product (5) through another check valve. By repeating the operations, the inflatable product (5) fills with air.

The advantages of U.S. Pat. No. 5,827,052 include: the construction of the air pump (59) is simple and low cost; the air pump (59) requires less storage volume when fully compressed.

In the present invention, this inventor further simplifies the structure of the air pump (59) so as to reduce the cost and simplify the process of producing the inflatable product. Another asset of the present invention is that forming the pump body does not require additional materials.

SUMMARY OF THE INVENTION

An object of the present invention is to provide a simplified, low-cost air pump.

Another object of the present invention is to reduce the cost and simplify the process of producing inflatable products.

Another object of the present invention is to provide an air pump requiring no additional materials to form the pump body thereof.

The air pump of the present invention includes a first sheet, a second sheet, an inflation valve and a check valve. The second sheet is directly connected to the first sheet so as to form a chamber. The inflation valve is provided on the chamber to lead air into the chamber when the chamber is extended. The check valve is also provided on the chamber to discharge the air in the chamber wren the chamber is compressed. The air pump can be built in an inflatable product.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1A:
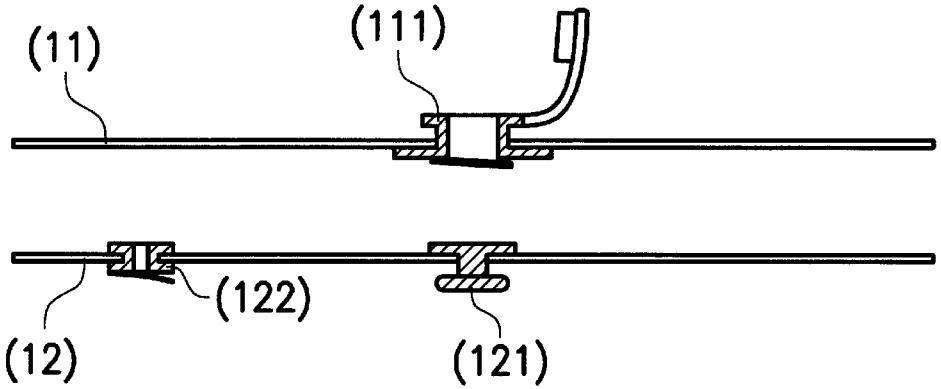
FIGS. 1A–1C show the process of producing an air pump of the present invention.
Figure 1B:
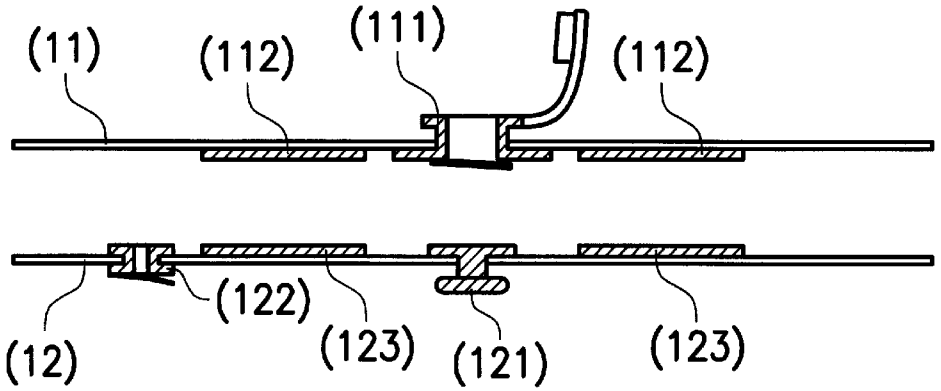
Figure 1C:
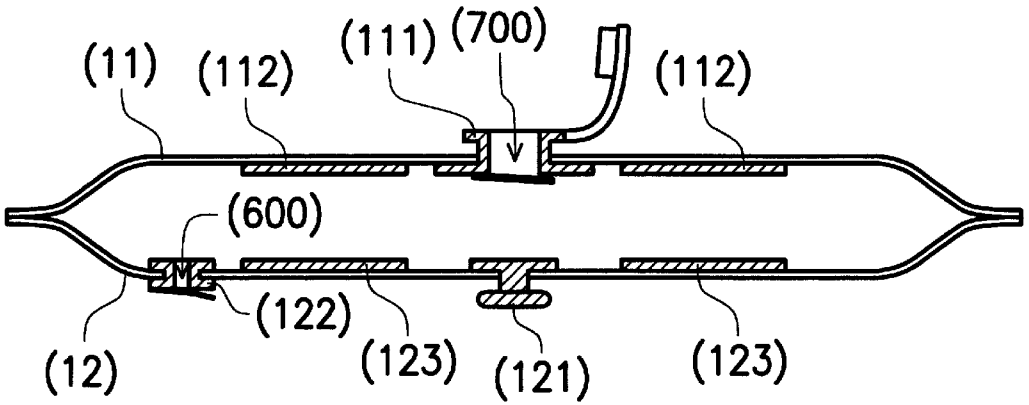

The process of producing an air pump in accordance with the present invention is described now. As shown in FIG. 1A, a first plastic sheet (11) provided with an inflation valve (111) and a second plastic sheet (12) provided with a handle (121) and a check valve (122) are prepared. Then, as shown in FIG. 1B, stiff members (112) and (123) are attached to the first and second plastic sheets (11) and (12), respectively. The second plastic sheet (12) is covered by the first plastic sheet (11). Then, the first plastic sheet (11) and the second plastic sheet (12) are heat-sealed together at their rims, as shown in FIG. 1C, to form an air pump. It is noted that the first plastic sheet (11) and the second plastic sheet (12) are directly heat-sealed together. Forming the pump body does not require additional materials.

In operation, the user simultaneously holds the inflation valve (111) and the handle (121) to extend the air pump. Outside air (700) is sucked into the air pump via the inflation valve (111). Then, the user compresses the air pump and discharges air (600) in the air pump via the check valve (122).

Figure 2A:
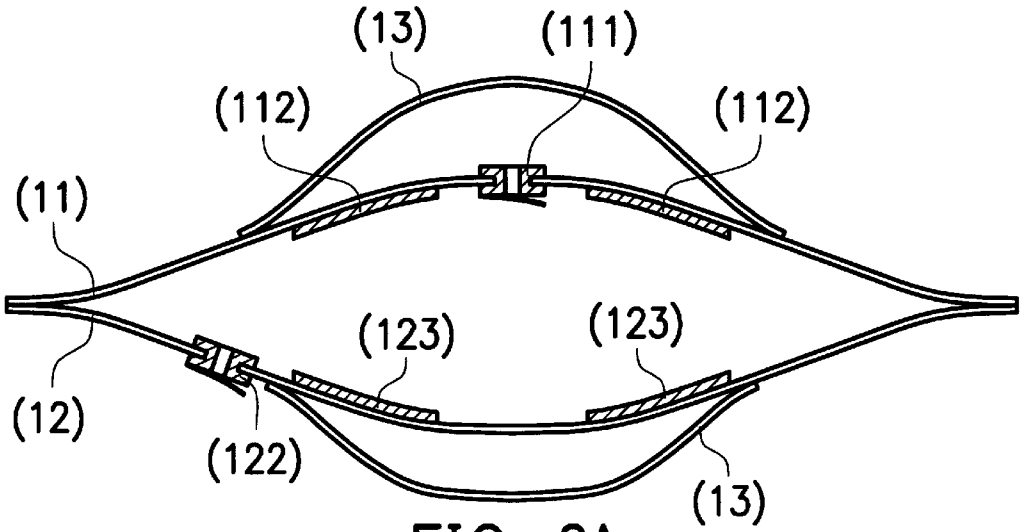
FIG. 2A is a sectional view of a modified air pump of the present invention.
Figure 2B:
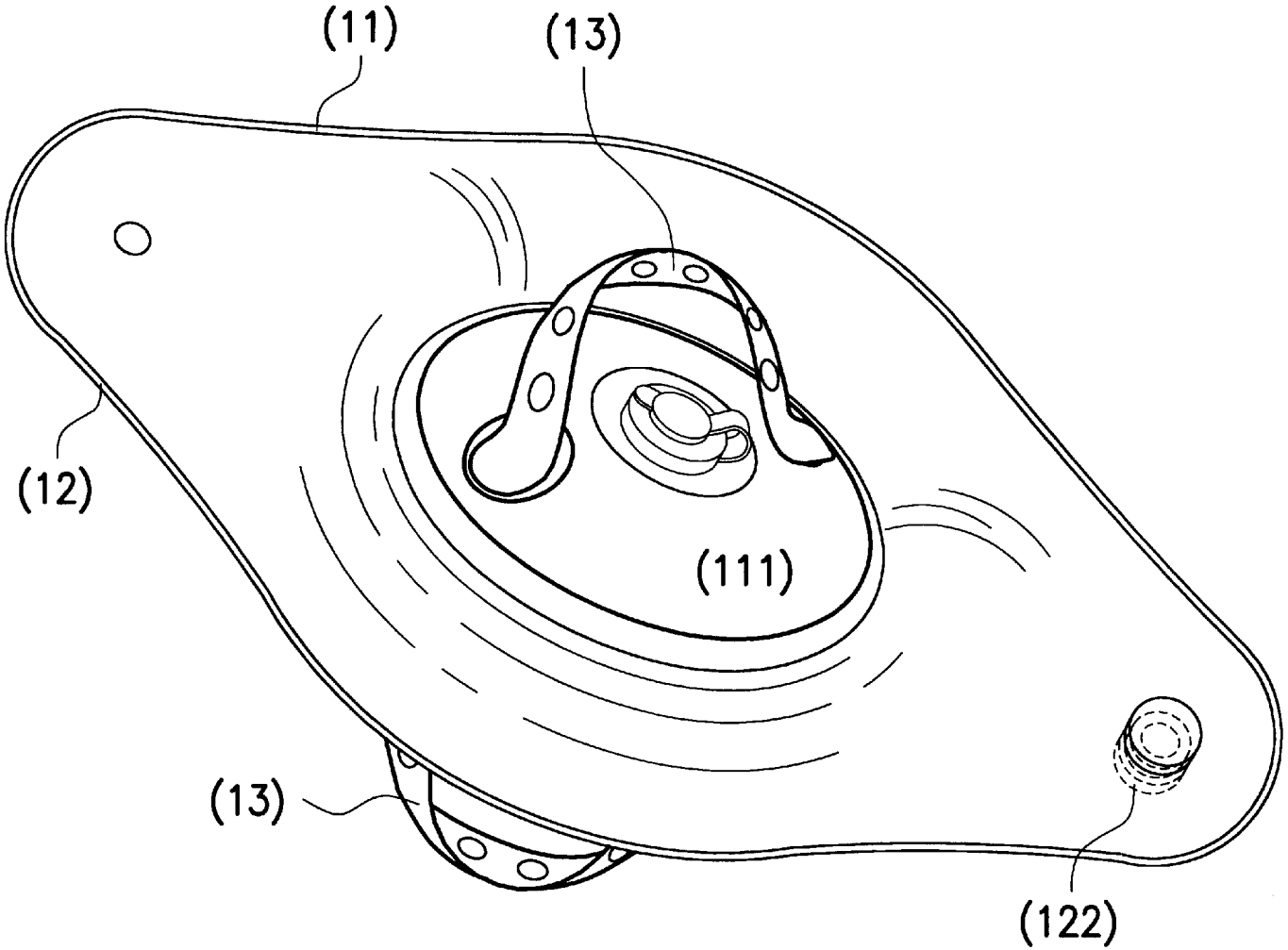
FIG. 2B is a perspective diagram of the modified air pump of FIG. 2A.

FIGS. 2A and 2B depict a modified air pump of the present invention, in which the above-mentioned handle is not used. Instead, two bands (13) are attached to the first and second plastic sheets (11), (12) for the operation on the air pump by the user.

Figure 3:
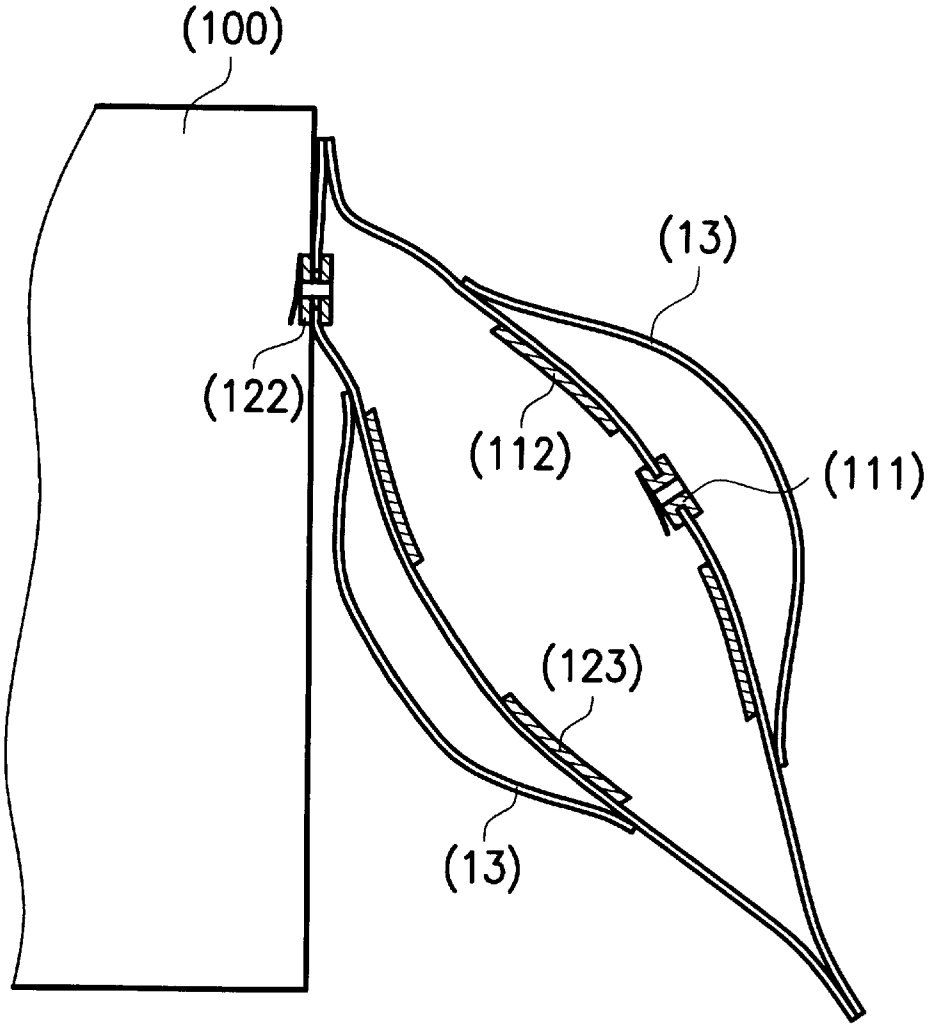
FIG. 3 depicts a first application example of the air pump of the present invention.

FIG. 3 depicts a first application example of the air pump of the present invention, wherein the air pump is firmly attached onto an inflatable product (100), with the check valve (122) of the air pump communicating both insides of the inflatable product and the air pump. By this arrangement, the inflatable product (100) can be pumped by the air pump.

Figure 4:
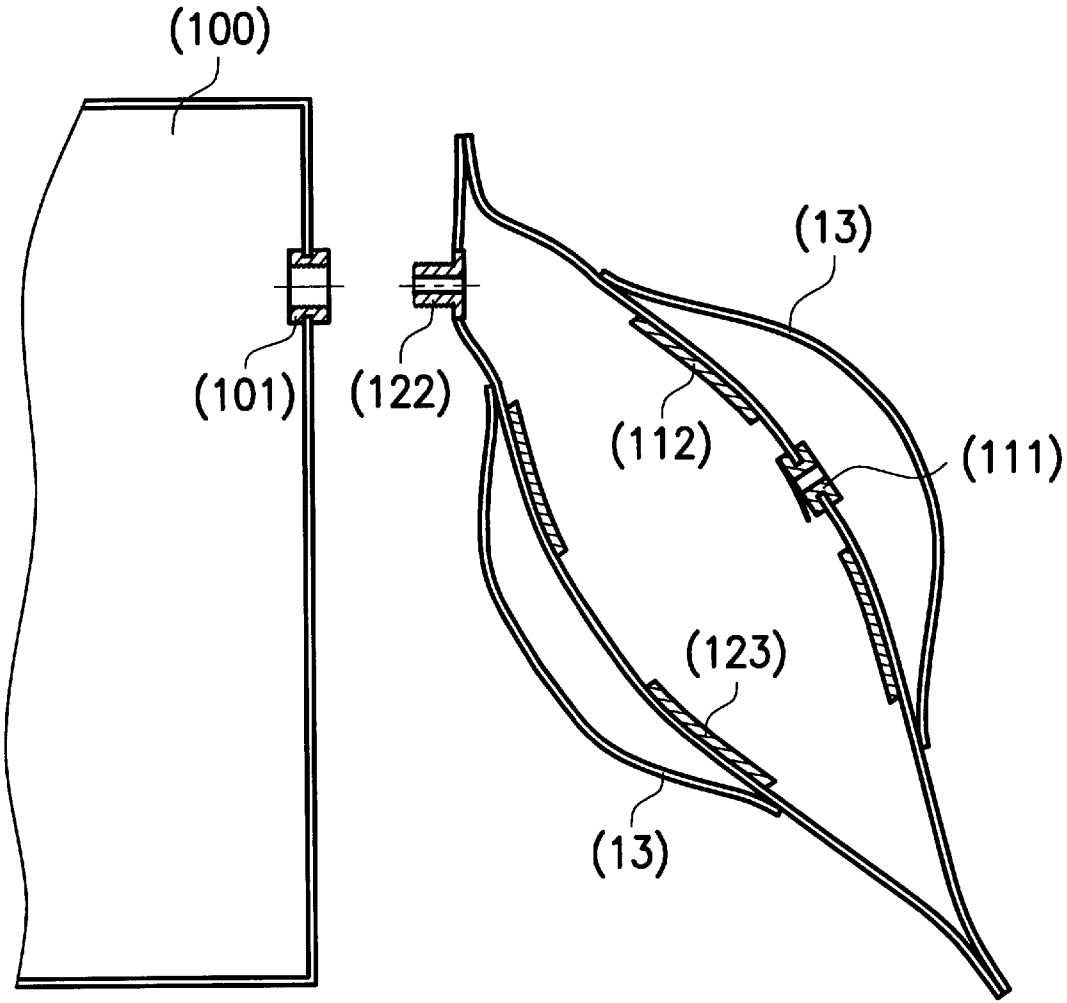
FIG. 4 depicts a second application example of the air pump of the present invention.

FIG. 4 depicts a second application example of the air pump, wherein the air pump is detachably connected to the inflatable product (100). In detail, the check valve (122) of the air pump is provided with screw threads, while a threaded connection (101) is fitted on the inflatable product (100). The check valve (122) of the air pump is screwed to the connection (101) so as to pump the inflatable product (100) by the air pump. On the other hand, the check valve (122) is detached from the inflatable product (100) when the pumping operation is finished.

The arrangement of the stiff members (112), (123) facilitates the extension of the air pump. However, it should be noticed that the air pump of the present invention can be operated even without the arrangement of stiff members. It is described in the following third application example.

Figure 5A:
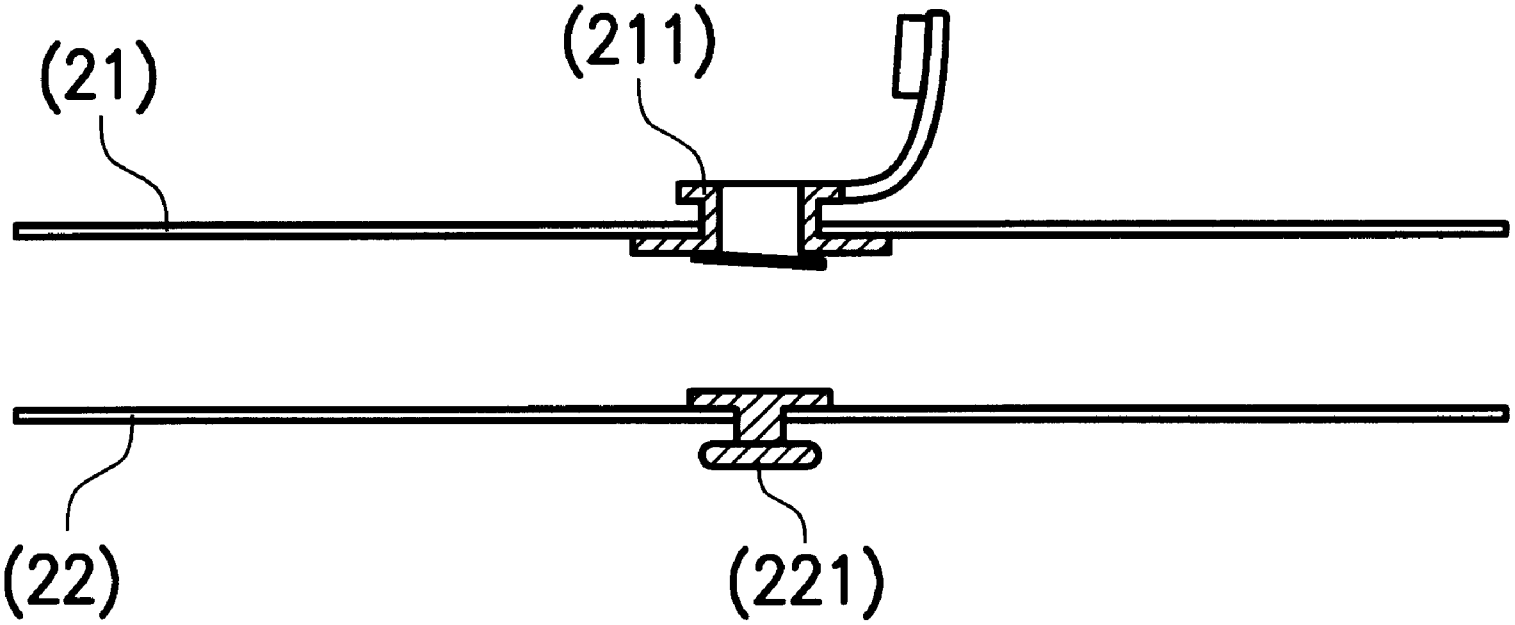
FIGS. 5A–5D show the process of producing an inflatable product in accordance with a third application example of the present invention.
Figure 5B:
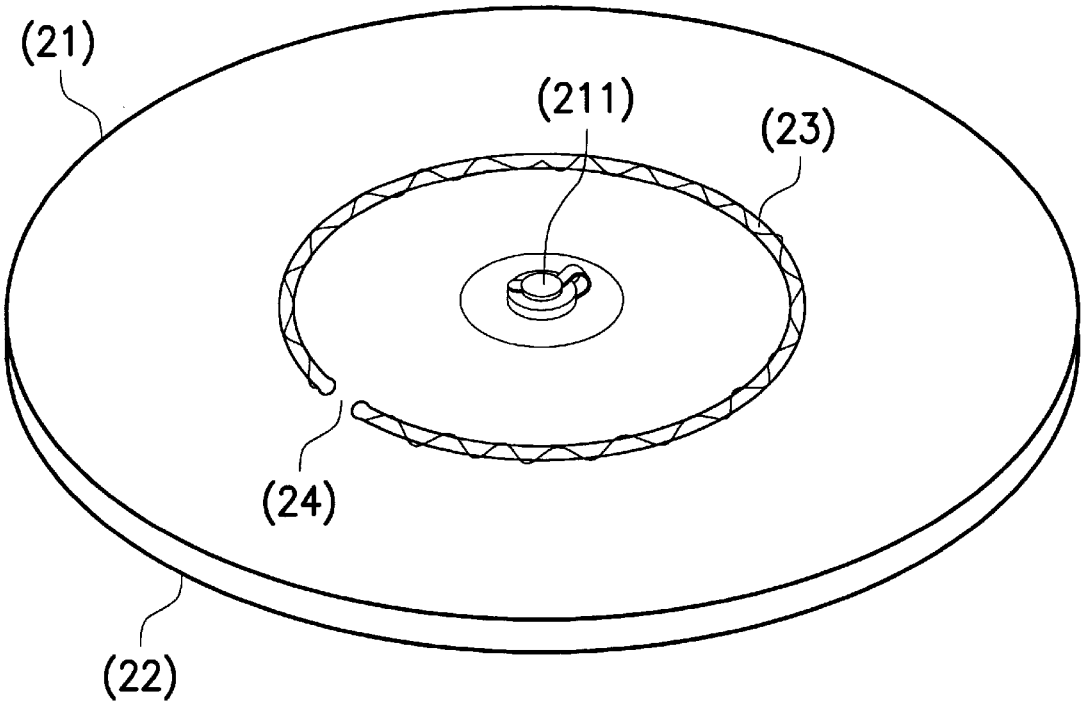
Figure 5C:
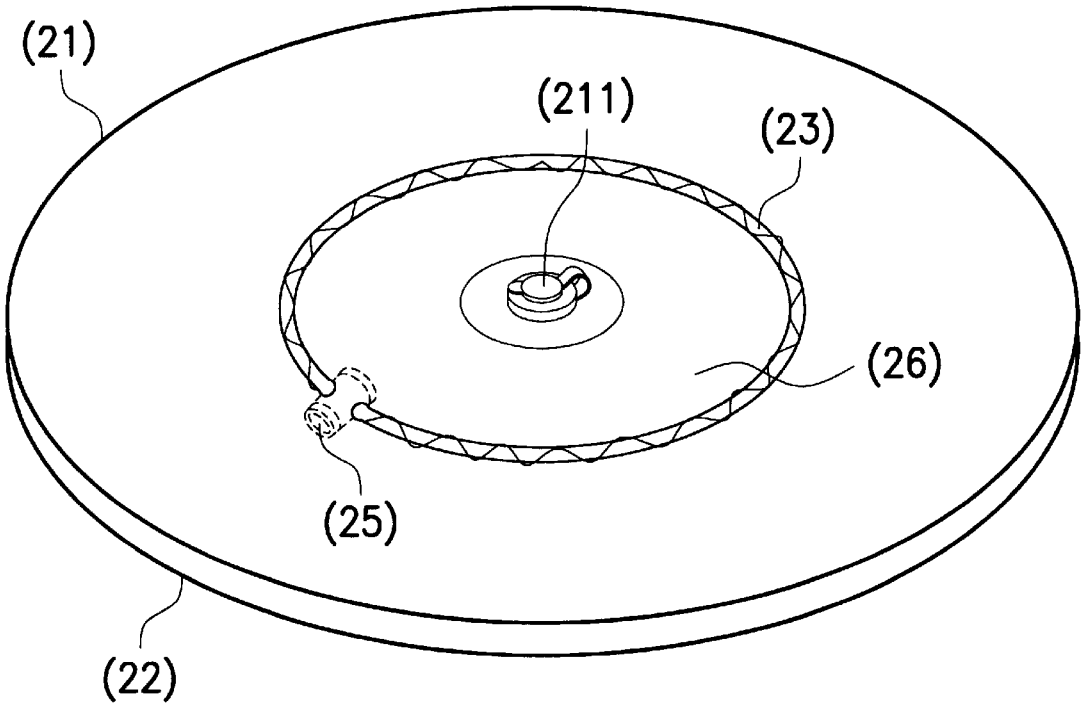
Figure 5D:
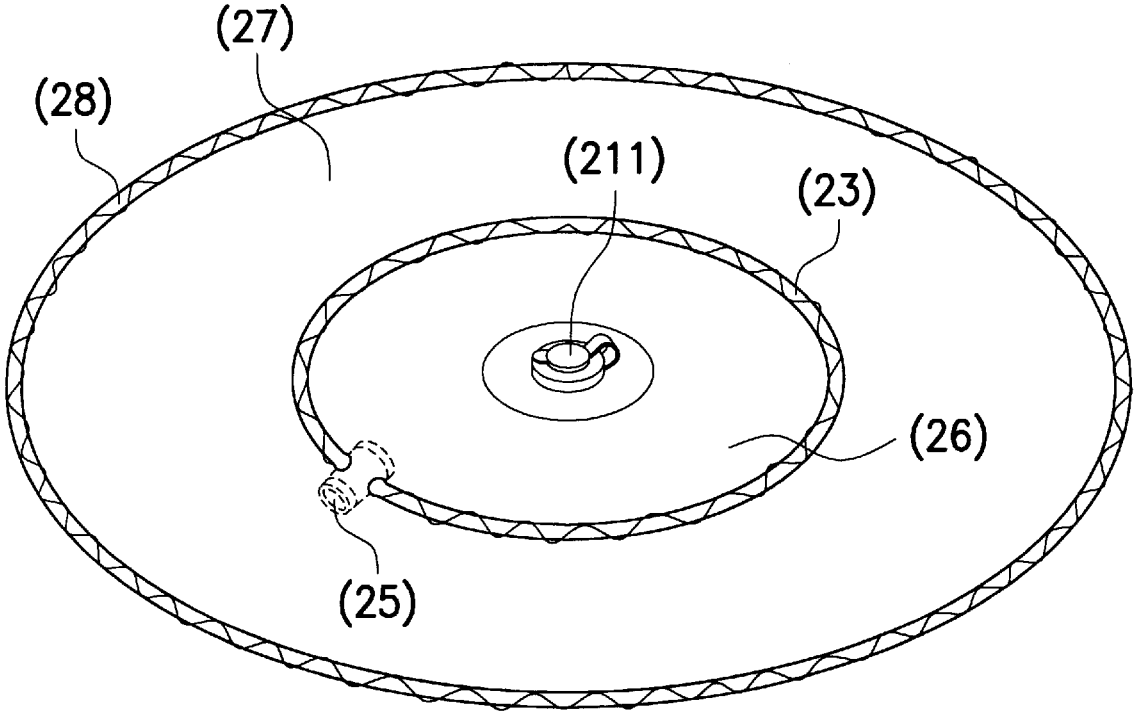
Figure 5E:
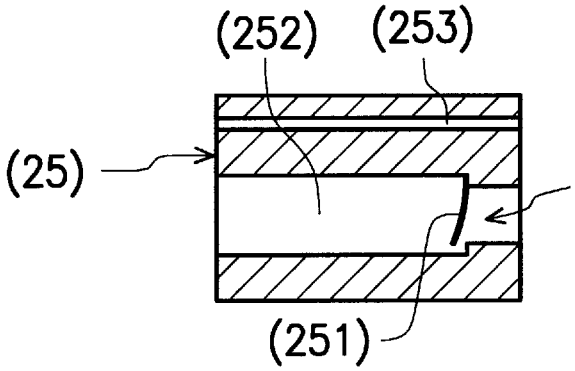
FIG. 5E is a longitudinally sectional view of a check valve of the inflatable product in accordance with the third application example of the present invention.
Figure 5F:
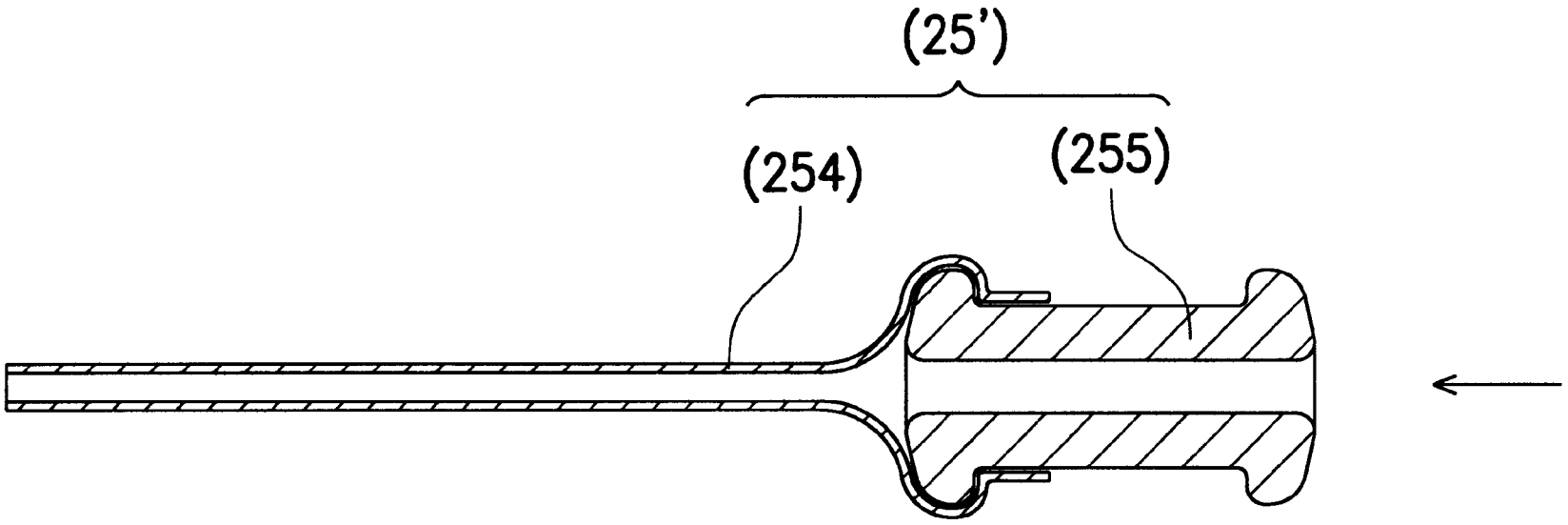
FIG. 5F shows a modification of the check valve of FIG. 5E.

In a third application example of the present invention, the air pump is built in an inflatable product. As shown in FIG. 5A, a first plastic sheet (21) provided with an inflation valve (211) and a second plastic sheet (22) provided with a handle (221) are prepared. The second plastic sheet (22) is covered by the first plastic sheet (21). Then, the first plastic sheet (21) and the second plastic sheet (22) are heat-sealed together around the inflation valve (211) as shown in FIG. 5B. The ends of the weld lines (23) do not meet each other so as to form an opening (24) between the first and second plastic sheets. Then, a check valve (25) is fitted into the opening (24) as shown in FIG. 5C. Then, the first plastic sheet (21) and the second plastic sheet (22) are heat-sealed at their rims (28) as shown in FIG. 5D. As a result, surrounded by the weld line (23) is a first chamber (26). Between the weld lines (23) and (28) is a second chamber (27). FIG. 5E is a longitudinally sectional view of the check valve (25), wherein the check valve (25) has a passage (252) and a back-flow hole (253). A flap (251) is provided in the passage (252), allowing airflow to pass through in a single direction. FIG. 5F is a longitudinally sectional view of a modified check valve (25'), wherein the check valve (25') includes a tube (255) and a flexible sleeve (254) connected together. The flexible sleeve (254) normally is flat. By this arrangement, airflow can only flow in a single direction from the tube (255) to the flexible sleeve (254).

Figure 6A:
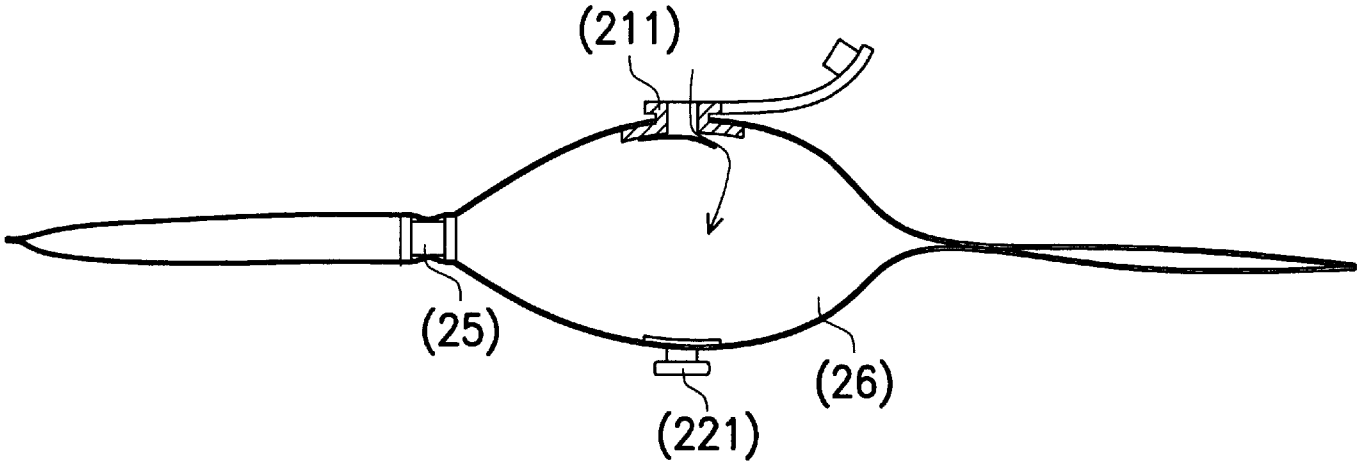
FIGS. 6A–6C depict the operation of the built-in air pump of the inflatable product in accordance with the third application example of the present invention.
Figure 6B:
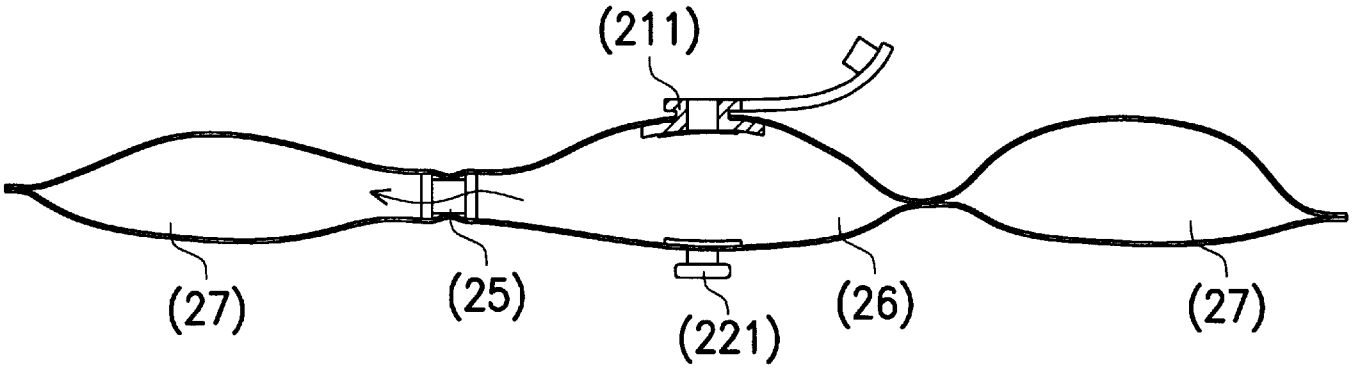
Figure 6C:
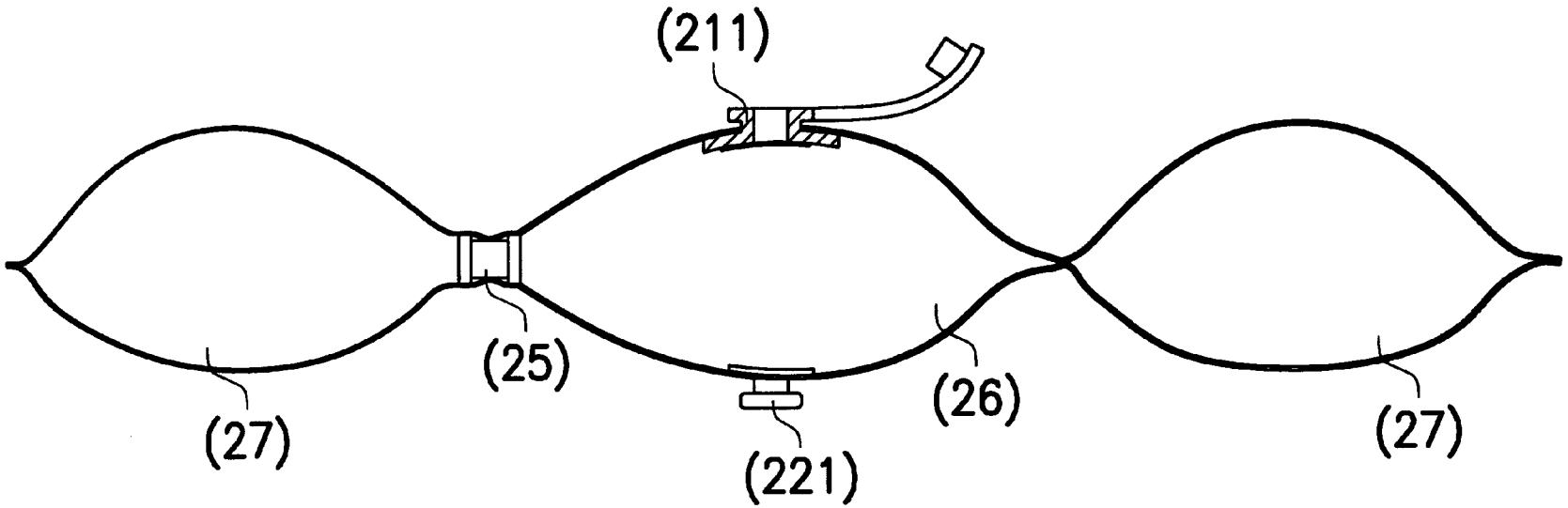

The first chamber (26), the inflation valve (211) and the check valve (25) constitute the built-in air pump of the inflatable product. It is noted that forming the first chamber (26), i.e. the pump body, does not require additional materials. Instead, the first chamber (26) of the air pump is made entirely of the materials of the inflatable product. In operation, the user simultaneously holds the inflation valve (211) and the handle (221) to extend the first chamber (26). Outside air is sucked into the first chamber (26) via the inflation valve (211) as shown in FIG. 6A. Then, the user compresses the first chamber (26) as shown in FIG. 2B, forcing the air into the second chamber (227) via the check valve (25). The second chamber (27) can be filled with air by repeating such operations. The back-flow hole (253) of the check valve (25) shown in FIG. 5E allows part of the air in the second chamber (27) to flow back to the first chamber (26) so that the whole inflatable product fills with air, as shown in FIG. 6C.

Figure 6D:
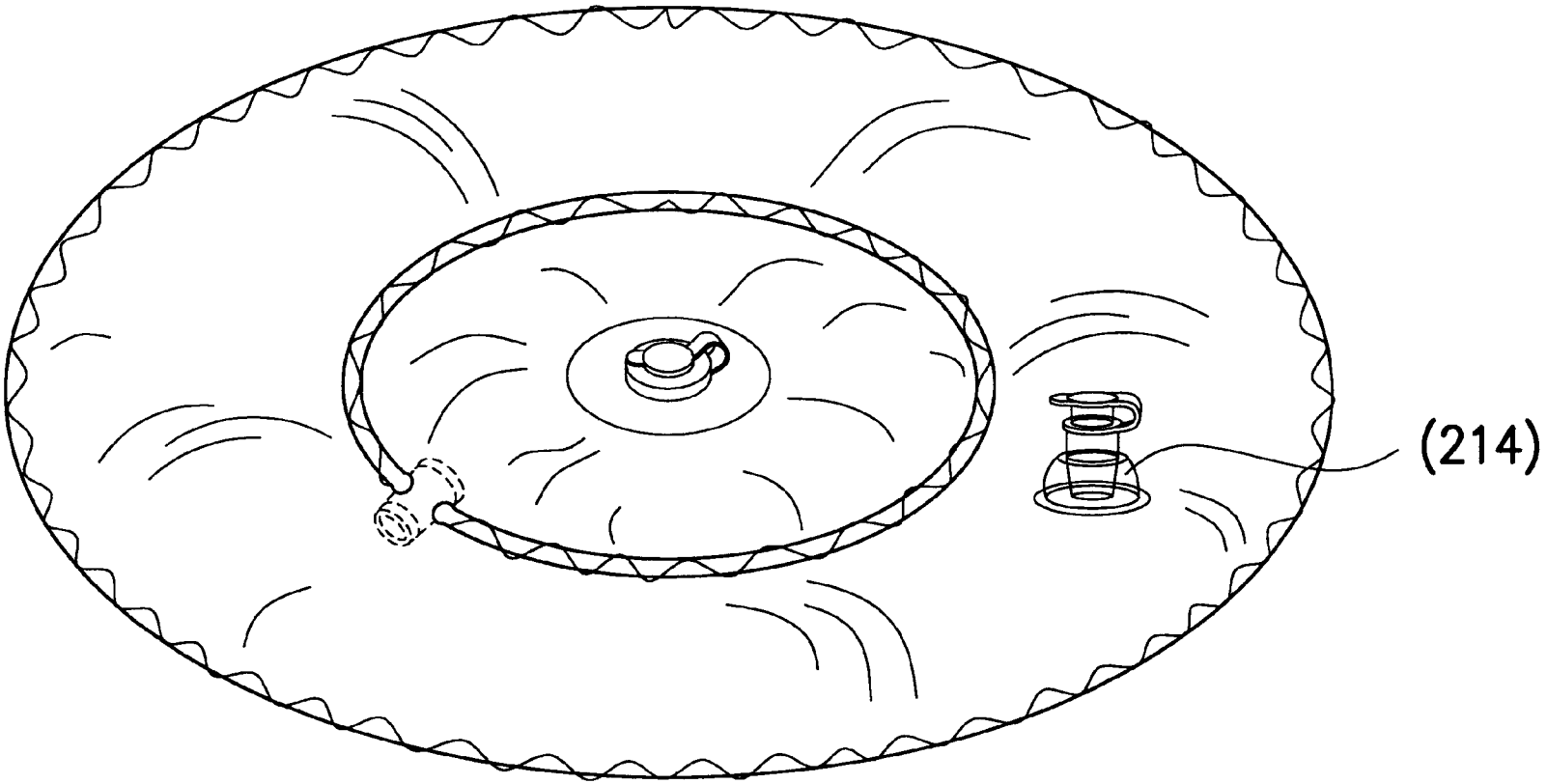
FIG. 6D depicts an inflatable product manufactured in accordance with the third application example of the present invention.

In the practical application, a deflating valve (214) is necessarily provided on the second chamber (27) as shown in FIG. 6D to deflate the inflatable product when the inflatable product is not in use.

Figure 6E:
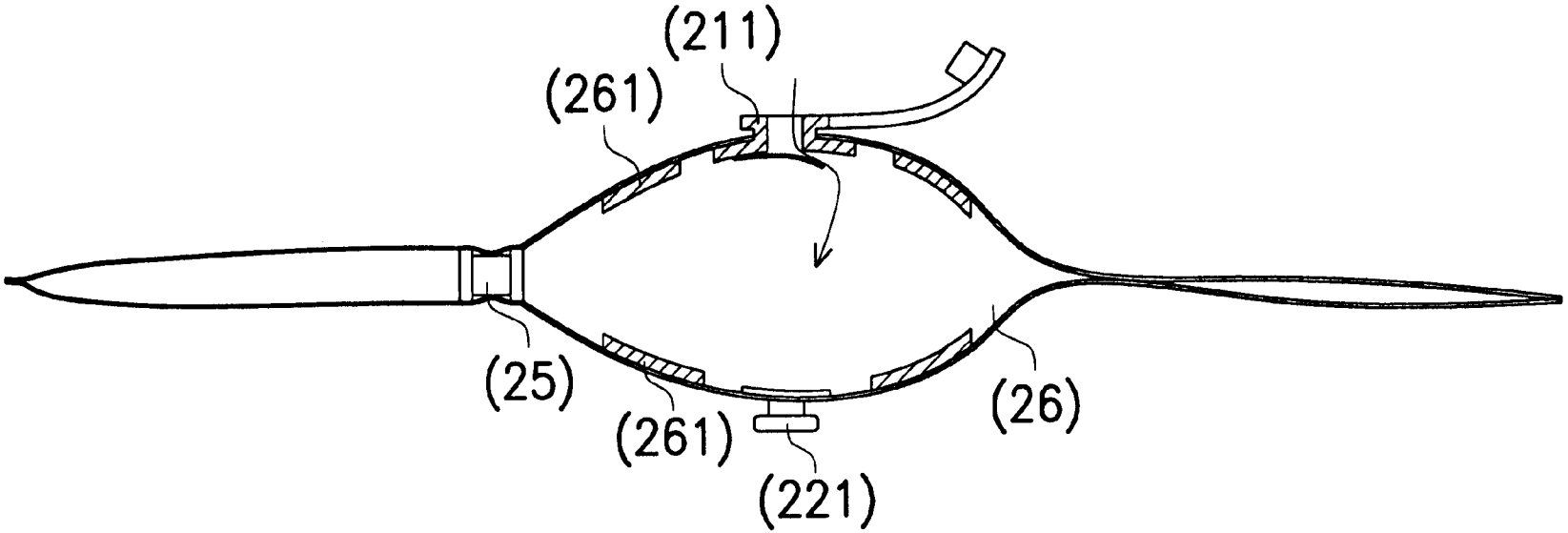
FIG. 6E shows a modification of the inflatable product manufactured in accordance with the third application example of the present invention.

It should oe understood that the built-in air pump in the third application example also operates well if stiff members (261) are attached onto the inner walls of the first chamber (26), as shown in FIG. 6E.

Figure 7A:
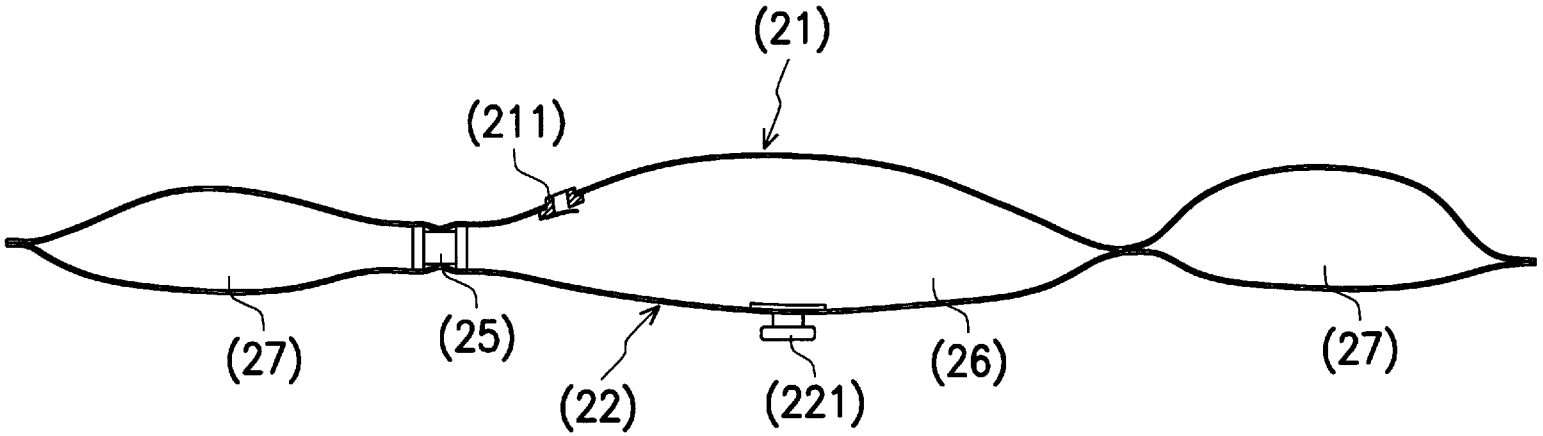
FIGS. 7A–7C show the process of producing an inflatable product provided with a modified air pump of the third application example of the present invention.
Figure 7B:
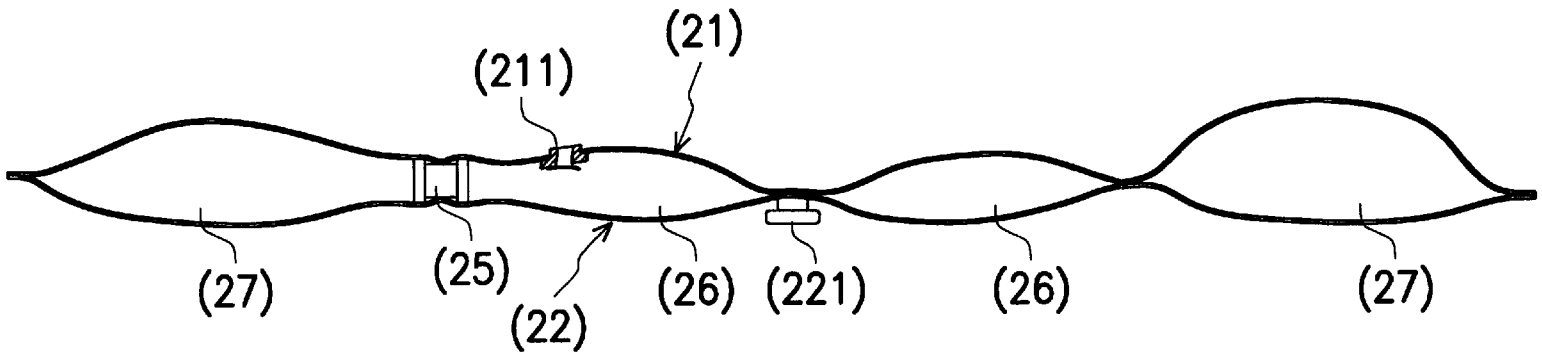
Figure 7C:
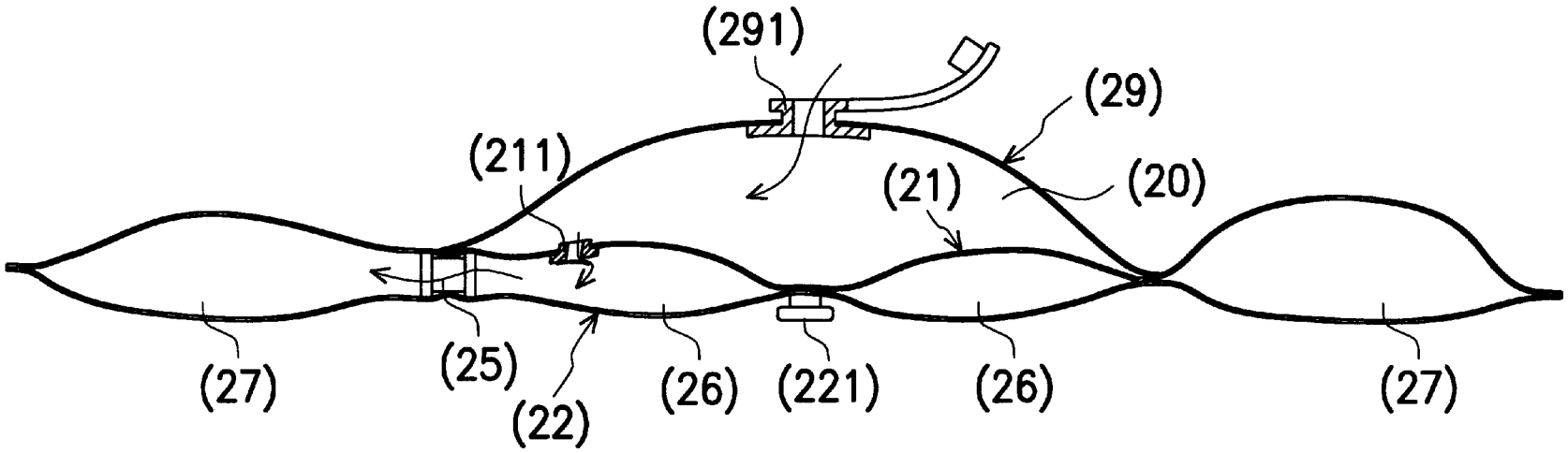

The air pump of the third application example can be further modified. The inflation valve (211) is moved away from the center of the first plastic sheet (21) as shown in FIG. 7A. Then, the first plastic sheet (21) and the second plastic sheet (22) are heat-sealed at the position of the handle (221) as shown in FIG. 7B. Then, a third plastic sheet (29) provided with an inflation valve (291) is heat-sealed to the first plastic sheet (21) so as to form a third chamber (20). In operation, the user simultaneously holds the inflation valve (291) and the handle (221) to extend the third chamber (20) so that outside air is sucked into the third chamber (20) via the inflation valve (291). Then, the user compresses the third chamber (20), forcing the air into the first chamber (26) via the inflation valve (211) and further into the second chamber (27) via the check valve (25). The second chamber (27) can be filled with air by repeating such operations.

Figure 8A:
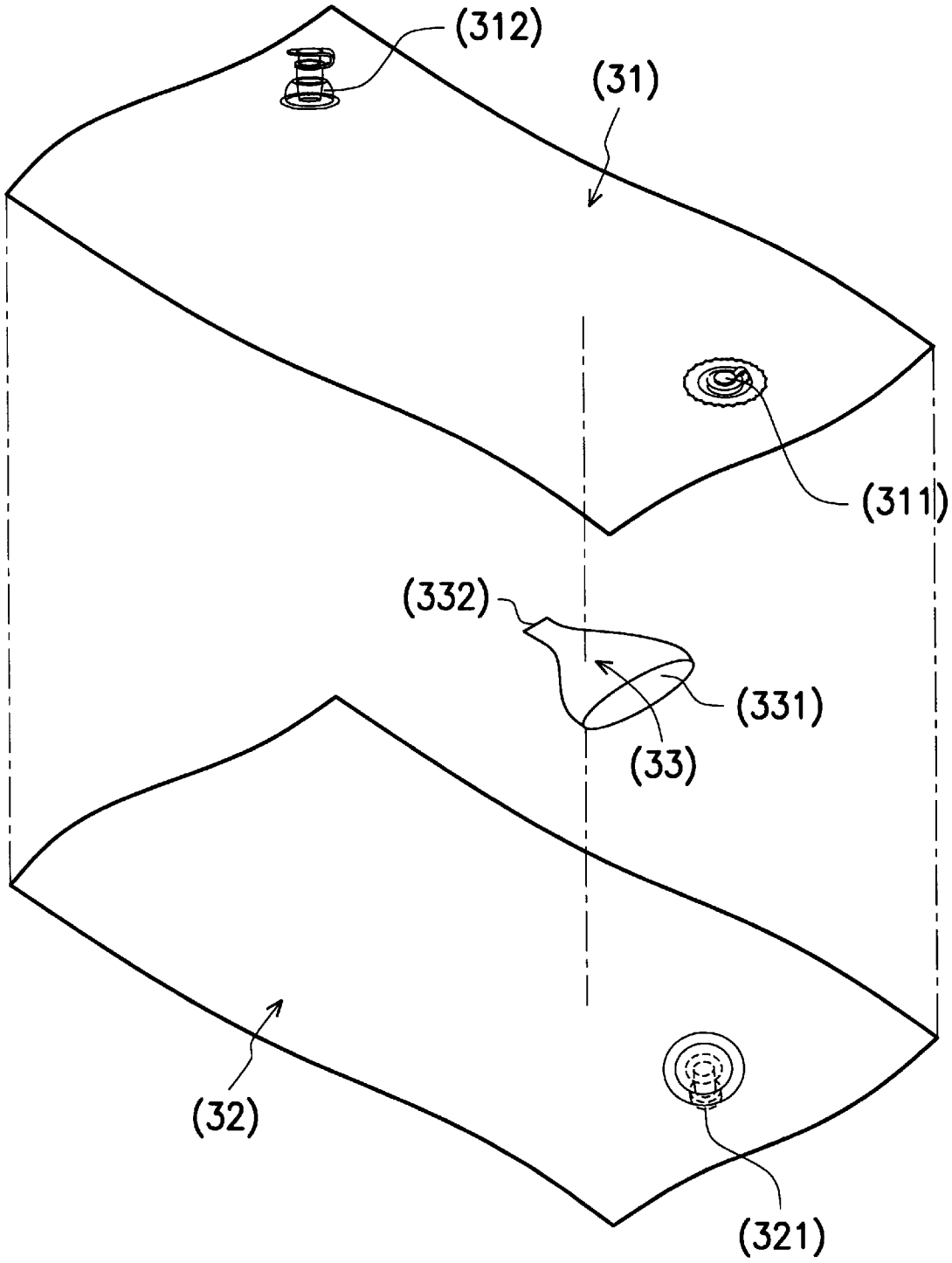
FIGS. 8A–8D show the process of producing an inflatable product in accordance with a fourth application example of the present invention.
Figure 8B:
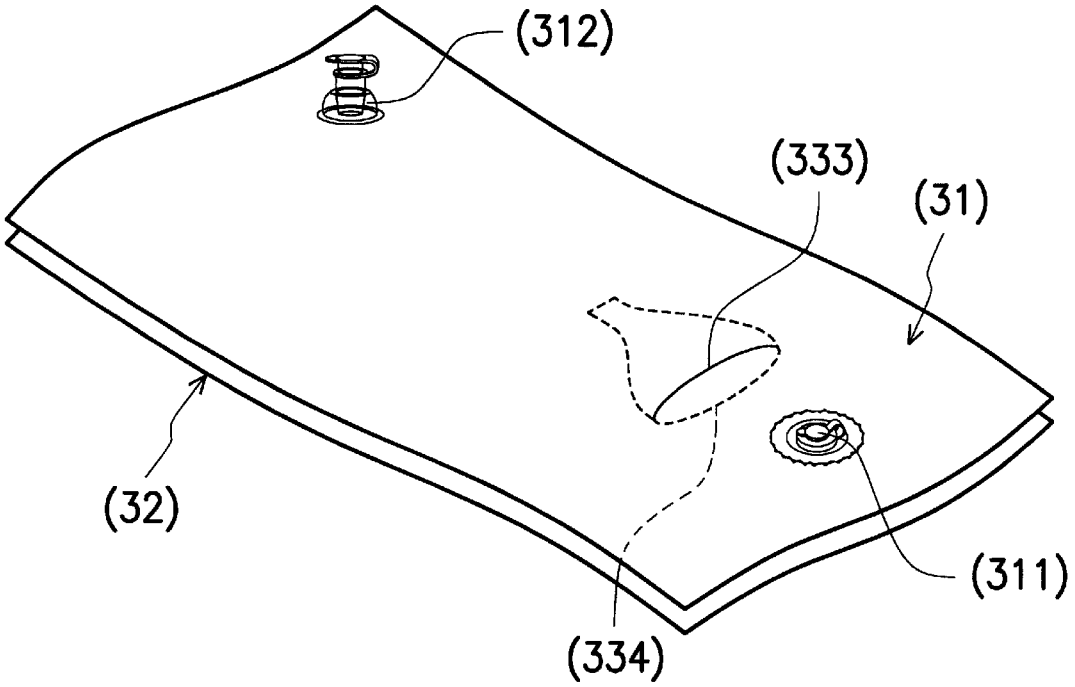
Figure 8C:
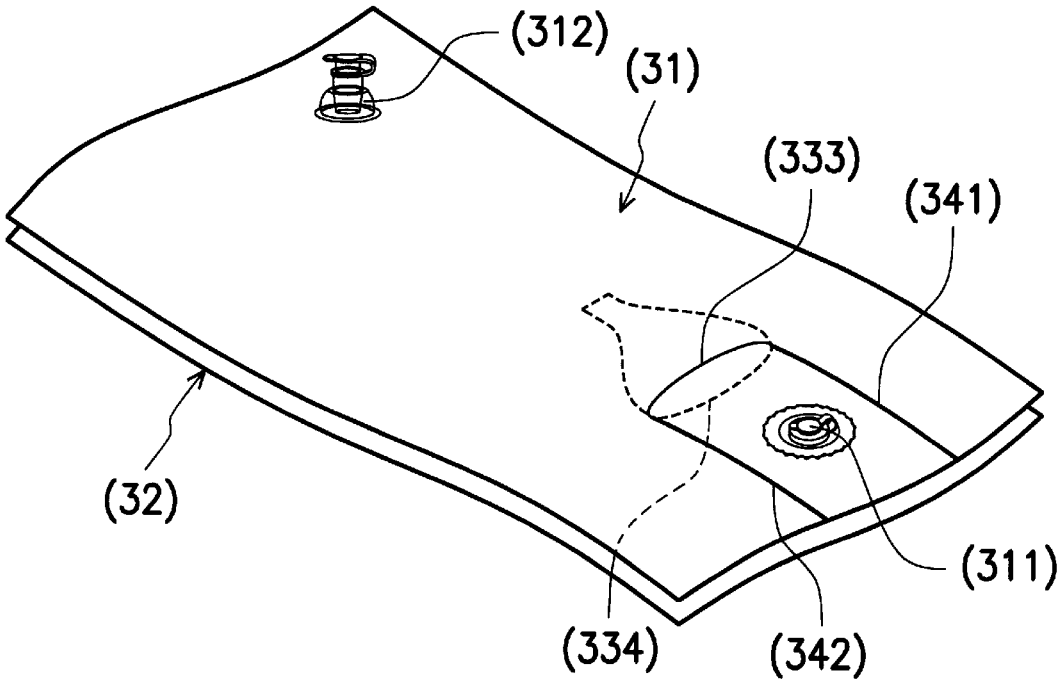
Figure 8D:
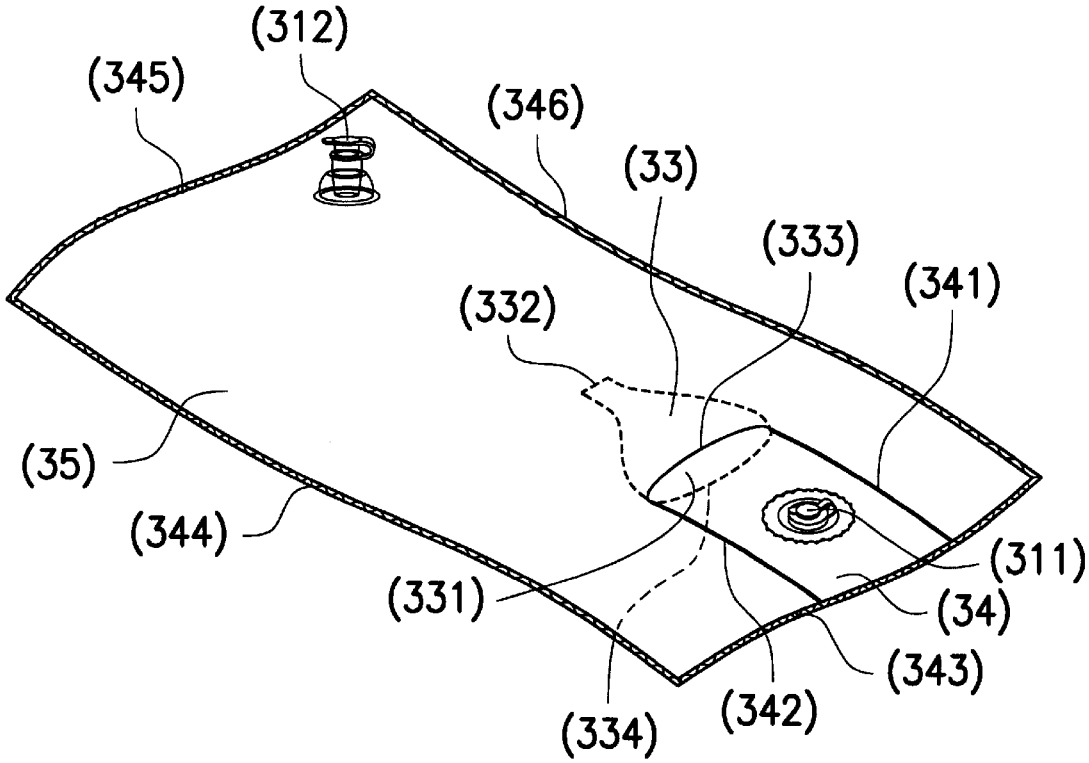

The process of producing an inflatable product in accordance with a fourth application example of the present invention is described now. As shown in FIG. 8A, a first plastic sheet (31), a second plastic sheet (32) and a check valve (33) are prepared. The first plastic sheet (31) is provided with an inflation valve (311) and a deflating valve (312), while the second plastic sheet (32) is provided with a handle (321). The check valve (33) has an inlet (331) and an outlet (332). The check valve (33) is indeed a sleeve made of plastic material. Therefore, the sleeve normally is flat and the inlet (331) and outlet (332) are close. Referring to FIG. 8B, the check valve (33) is put between the first plastic sheet (31) and the second plastic sheet (32). Then, the upper rim of the inlet (331) is heat-sealed to the first plastic sheet (31). Also, the lower rim of the inlet (331) is heat-sealed to the second plastic sheet (32). Reference numbers (333) and (334) represent the weld lines. Then, the first plastic sheet (31) and second plastic sheet (32) are heat-sealed together so as to form a first chamber (34) and a second chamber (35), as shown in FIGS. 8C and 8D. Reference numbers (341)–(346) represent the weld lines.

Figure 8E:
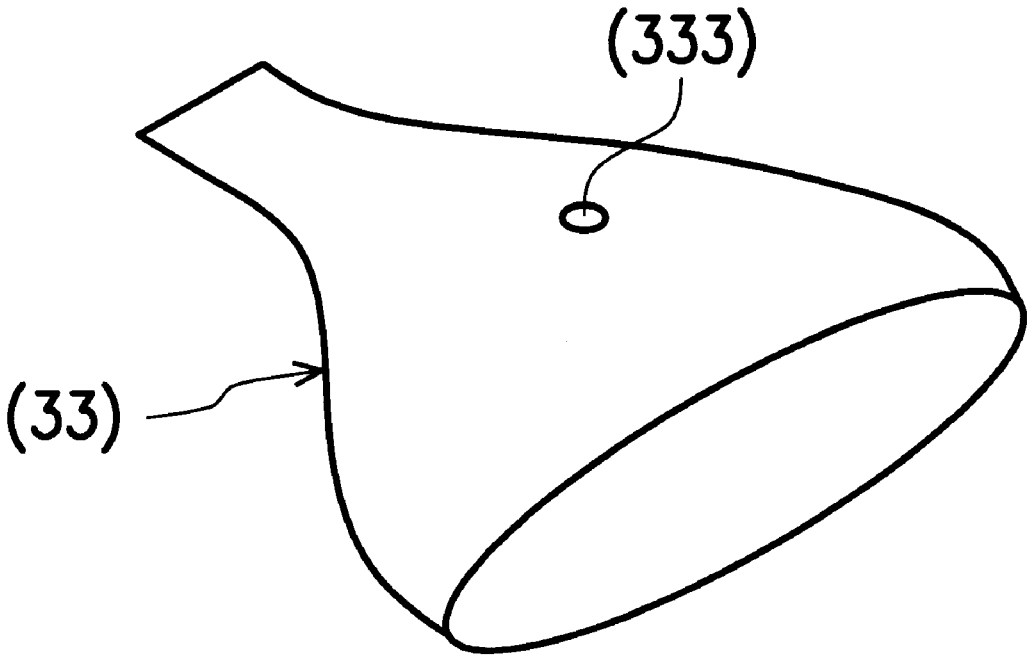
FIG. 8E depicts a back-flow hole provided on the check valve of the air pump in accordance with the fourth application example of the present invention.
Figure 9A:
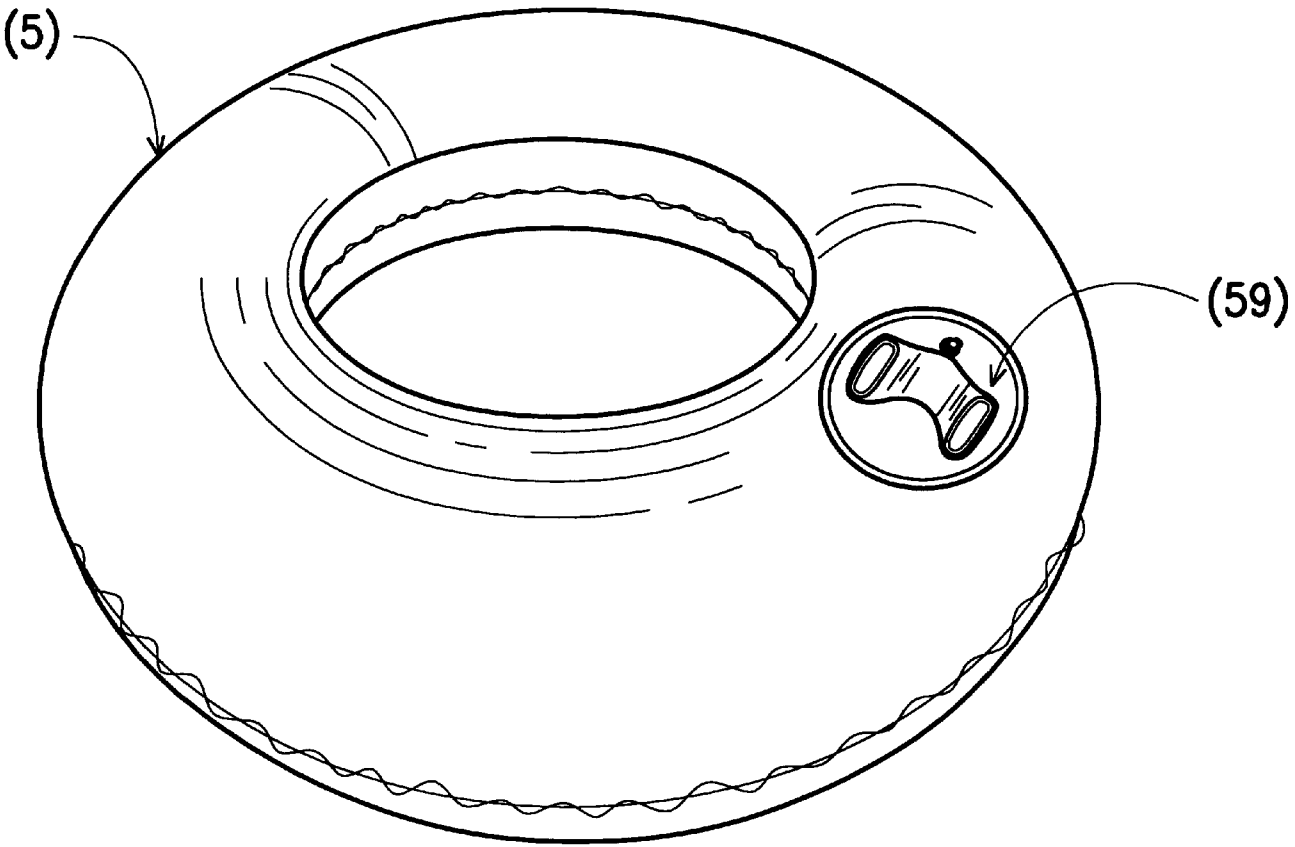
FIG. 9A (PRIOR ART)
FIGS. 9A and 9B show an embodiment of U.S. Pat. No. 5,827,052.
Figure 9B:
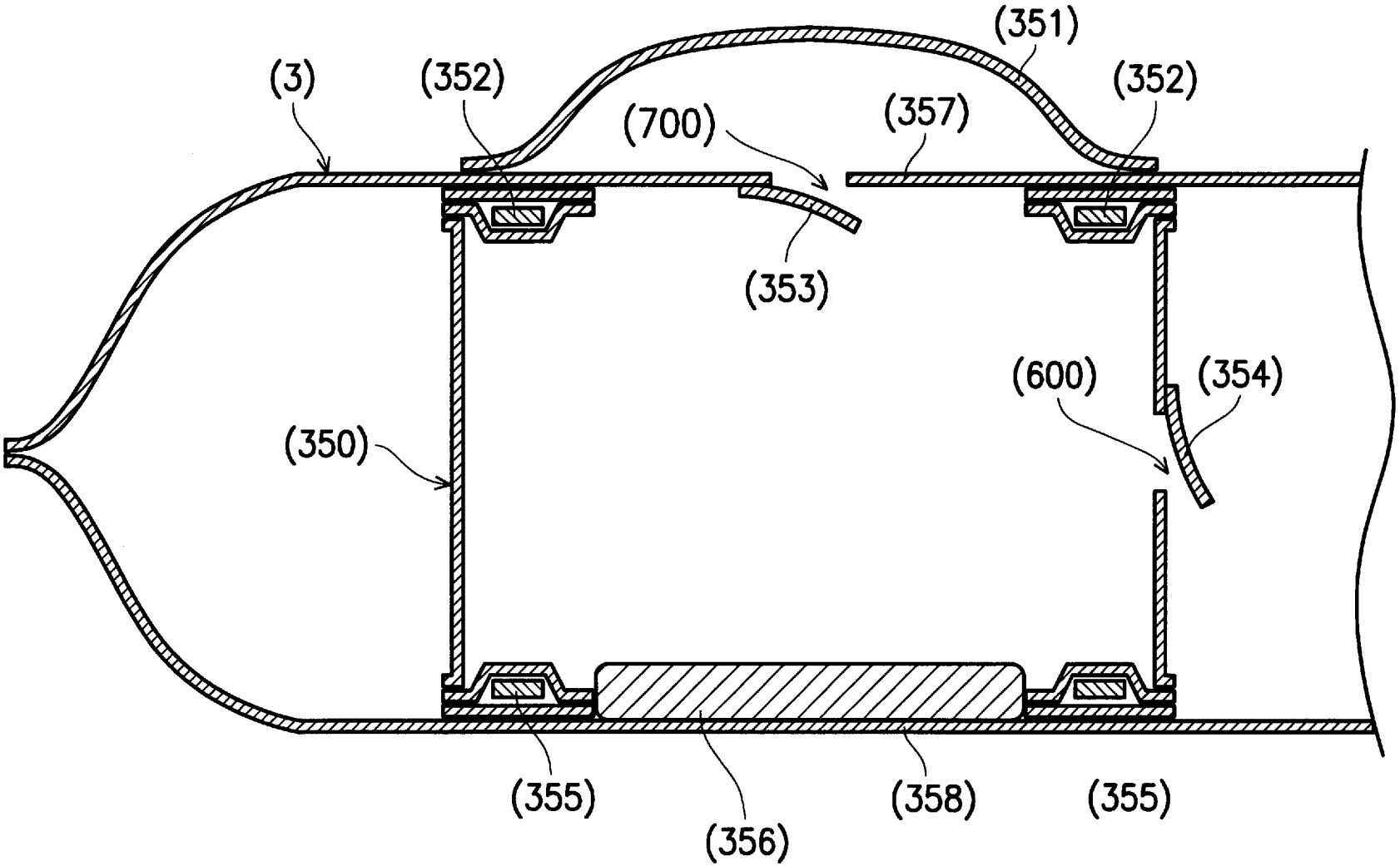
FIG. 9B (PRIOR ART)

The first chamber (34), the inflation valve (311) and the check valve (33) constitute the built-in air pump of the inflatable product. Forming the first chamber (34), i.e. the pump body, does not require additional materials. Instead, the first chamber (34) of the air pump is made entirely of the materials of the inflatable product. In operation, the user simultaneously holds the inflation valve (311) and the handle (321) to extend the first chamber (34). Outside air is sucked into the first chamber (34) via the inflation valve (311). The inlet (331) of the air pump is opened by the extending force because the upper rim and lower rim of the inlet (331) are respectively heat-sealed to the first plastic sheet (31) and second plastic sheet (32). However, the outlet (332) of the air pump is closed. Then, the user compresses the first chamber (34), forcing the outlet (332) of the air pump to open by air pressure so that the air in the first chamber (34) flows into the second chamber (35). The second chamber (35) can be filled with air by repeating such operations. It is understood that the outlet (332) of the check valve (33) is generally closed so that air in the second chamber (35) cannot flow back to the first chamber via the outlet (332). It is also understood that a back-flow hole (333) can be provided on the check valve (33), as shown in FIG. 8E. The back-flow hole (333) allows part of the air in the second chamber (35) to flow back to the first chamber (34) so that the whole inflatable product fills with air.

Compared to the air pump of the prior art, the air pump of the present invention is simplified so as to reduce the cost and simplify the process of producing the inflatable product. Furthermore, ir the present invention, forming the pump body does not require additional materials. Instead, the air pump of the present invention is made entirely of two plastic sheets.

The structure of the air pump of the present invention is very simple, so the present invention is particularly suitable for inflatable beach toys such as air mattresses which generally are inexpensive.

While the invention has been described by way of example and in terms of the preferred embodiment, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inflatable product, comprising:

a first sheet;

a second sheet directly connected to the first sheet to form a first chamber and a second chamber;

a first inflation valve provided on the first chamber to lead air into the first chamber; and a check valve communicating the first chamber and the second chamber to lead the air from the first chamber into the second chamber.

2. An inflatable product as claimed in claim 1, wherein the check valve has a back-flow hole to lead the air in the second chamber back to the first chamber.

3. An inflatable product as claimed in claim 1, further comprising a third sheet connected to the first sheet to form a third chamber, and a second inflation valve provided on the third chamber.

4. An inflatable product as claimed in claim 1, further comprising stiff members attached onto inner walls of the first chamber to facilitate an extension of the first chamber.

5. A method of producing an inflatable product, comprising the steps of:

(a) preparing a first sheet provided with an inflatable valve, a second sheet and a check valve;

(b) forming a first chamber and a second chamber by directly connecting the first sheet and the second sheet at proper positions; and (c) communicating the first and second chambers by the check valve.

6. A method of producing an inflatable product, comprising the steps of:

(a) preparing a first sheet provided with an inflatable valve, a second sheet and a check valve having an inlet;

(b) connecting a portion of the inlet to the first sheet and connecting another portion of the inlet to the second sheet; and (c) forming a first chamber and a second chamber by directly connecting the first sheet and the second sheet at proper positions.

7. An air pump consisting of:

a first sheet;

a second sheet directly connected to the first sheet so as to form a chamber;

an inflation valve provided on the chamber to lead air into the chamber when the chamber is extended; and a check valve also provided on the chamber to discharge the air in the chamber when the chamber is compressed.

8. An air pump consisting of:

a first sheet;

a second sheet directly connected to the first sheet to form a chamber;

an inflation valve provided on the chamber to lead air into the chamber when the chamber is extended;

a check valve also provided on the chamber to discharge the air in the chamber when the chamber is compressed; and stiff members connected to the chamber to facilitate extension of the chamber.

9. An air pump consisting of:

a first sheet;

a second sheet directly connected to the first sheet to form a chamber;

two bands attached to the chamber to extend the chamber;

stiff members connected to the chamber to facilitate extension of the chamber;

an inflation valve provided on the chamber to lead air into the chamber when the chamber is extended; and a check valve also provided on the chamber to discharge the air in the chamber when the chamber is compressed.

* * * * *